US008943831B2

(12) United States Patent
Eroglu et al.

(10) Patent No.: US 8,943,831 B2
(45) Date of Patent: Feb. 3, 2015

(54) LANCE OF A BURNER

(75) Inventors: Adnan Eroglu, Untersiggenthal (CH); Johannes Buss, Hohberg (DE); Andrea Ciani, Zürich (CH)

(73) Assignee: Alstom Technology Ltd, Baden (CH)

( * ) Notice: Subject to any disclaimer, the term of this patent is extended or adjusted under 35 U.S.C. 154(b) by 868 days.

(21) Appl. No.: 13/166,329

(22) Filed: Jun. 22, 2011

(65) Prior Publication Data

US 2012/0055162 A1 Mar. 8, 2012

(30) Foreign Application Priority Data

Jun. 23, 2010 (EP) ..... 10167024

(51) Int. Cl.
*F23R 3/36* (2006.01)
*F23D 17/00* (2006.01)

(52) U.S. Cl.
CPC ..... *F23D 17/002* (2013.01); *F23R 3/36* (2013.01); *F23C 2900/07021* (2013.01)
USPC ..... 60/740; 60/746; 239/422; 239/424

(58) Field of Classification Search
CPC . F23R 3/36; F23D 17/002; F23C 2900/07021
USPC ..... 60/737, 740, 742, 746; 239/422, 424, 239/549; 431/8, 10
See application file for complete search history.

(56) References Cited

U.S. PATENT DOCUMENTS

| | | | | |
|---|---|---|---|---|
| 5,361,578 | A | 11/1994 | Donlan | |
| 5,487,659 | A | 1/1996 | Eroglu et al. | |
| 6,141,967 | A * | 11/2000 | Angel et al. | 60/737 |
| 6,402,059 | B1 * | 6/2002 | Benz et al. | 239/422 |
| 7,934,381 | B2 | 5/2011 | Eroglu et al. | |

FOREIGN PATENT DOCUMENTS

| | | |
|---|---|---|
| DE | 199 05 995 | 8/2000 |
| EP | 0 638 769 A2 | 2/1995 |
| EP | 0 594 127 B1 | 7/1997 |
| EP | 2 072 899 A1 | 6/2009 |
| WO | WO 99/19670 | 4/1999 |
| WO | WO 2007/113074 | 10/2007 |

OTHER PUBLICATIONS

Search Report dated Aug. 4, 2011, issued in the corresponding European Application No. 11169973.2-1266.
Office Action issued on May 21, 2013, by the European Patent Office in corresponding European Patent Application No. 11 169 973.2. (5 pages).

* cited by examiner

*Primary Examiner* — J. Gregory Pickett
(74) *Attorney, Agent, or Firm* — Buchanan Ingersoll & Rooney PC

(57) ABSTRACT

The lance of a burner includes a body that defines a first duct with first nozzles for injecting a liquid fuel and a second duct with second nozzles for injecting a gaseous fuel. Outlets of the first nozzles are spaced apart from outlets of the second nozzles. The body includes a third duct with third and fourth nozzles for injecting air. The third nozzles surround an axis of the first nozzles and the fourth nozzles surround an axis of the second nozzles.

8 Claims, 1 Drawing Sheet

LANCE OF A BURNER

RELATED APPLICATION

This application claims priority under 35 U.S.C. §119 to European Patent Application No. 10167024.8 filed in Europe on Jun. 23, 2010, the entire content of which is hereby incorporated by reference in its entirety.

FIELD

The disclosure relates to a lance of a burner, for example, to a lance (or injection system) arranged to inject a liquid fuel or a gaseous fuel into a burner of a sequential combustion gas turbine, for example, reheat burners.

BACKGROUND INFORMATION

A reheat burner or second burner of a sequential combustion gas turbine can include a tubular mixing zone (for example, having a quadrangular or trapezoidal cross section) with a lance for injecting a fuel projecting thereinto.

EP2072899 discloses a lance for a reheat burner having a body with a first duct with first nozzles for a liquid fuel, a second duct with second nozzles for a gaseous fuel and a third duct with third nozzles for shielding air. For example, the third duct can encircle the second duct that, in turn, can encircle the first duct.

In this known lance, the nozzles are coaxial and, thus, their outlets can all be located at the same position.

During operation, while hot gases (coming from an upstream combustion chamber and turbine) pass through the tubular mixing zone, fuel (liquid or gaseous fuel) can be injected into the same mixing zone via the lance. Because of high temperature of the hot gases, after injection the fuel heats and after a prefixed time delay (depending on the particular fuel), it can start to spontaneously burn.

Nevertheless the features of liquid and gaseous fuel can be different and the delay time of a gaseous fuel can be longer than the delay time of a liquid fuel.

Because nozzles for liquid and gaseous fuel are coupled in nozzles groups (i.e., their outlets are all located at the same position), the dimensions and proportions of the lance and nozzles may not be optimized but have to suffer the constraints deriving from both liquid and gaseous fuels.

For this reason, liquid fuel can be injected together with water (i.e., when operating with liquid fuel a mixture of fuel and water is injected in the burner), in order to increase the ignition delay time to an amount allowing the correct operation of the burner. This can prevent the liquid fuel from starting to burn in the burner mixing zone, before it enters the downstream combustion chamber.

For these reasons, operation with liquid fuel could be very expensive, because in some places water is expensive.

EP 0 594 127 discloses a burner with a lance having a body with a first duct for injecting a liquid fuel and a second duct for injecting a gaseous fuel. These ducts have nozzles whose outlets are apart from each other.

SUMMARY

A lance for a burner is disclosed, a lance body comprising: a first duct with first nozzles for injecting a liquid fuel; a second duct with second nozzles for injecting a gaseous fuel, wherein outlets of the first nozzles are spaced apart from outlets of the second nozzles; and a third duct with third and fourth nozzles for injecting air, wherein the third nozzles surround an axis of the first nozzles and the fourth nozzles surround an axis of the second nozzles.

A reheat burner is disclosed, comprising a lance, including: a first duct with first nozzles for injecting a liquid fuel; a second duct with second nozzles for injecting a gaseous fuel, wherein outlets of the first nozzles are spaced apart from outlets of the second nozzles; and a third duct with third and fourth nozzles for injecting air, wherein the third nozzles surround an axis of the first nozzles and the fourth nozzles surround an axis of the second nozzles.

BRIEF DESCRIPTION OF THE DRAWINGS

Further characteristics and advantages of the disclosure will be more apparent from the description of the exemplary embodiments of the lance, illustrated by way of non-limiting examples in the accompanying drawings, in which.

DETAILED DESCRIPTION

Figure 1:
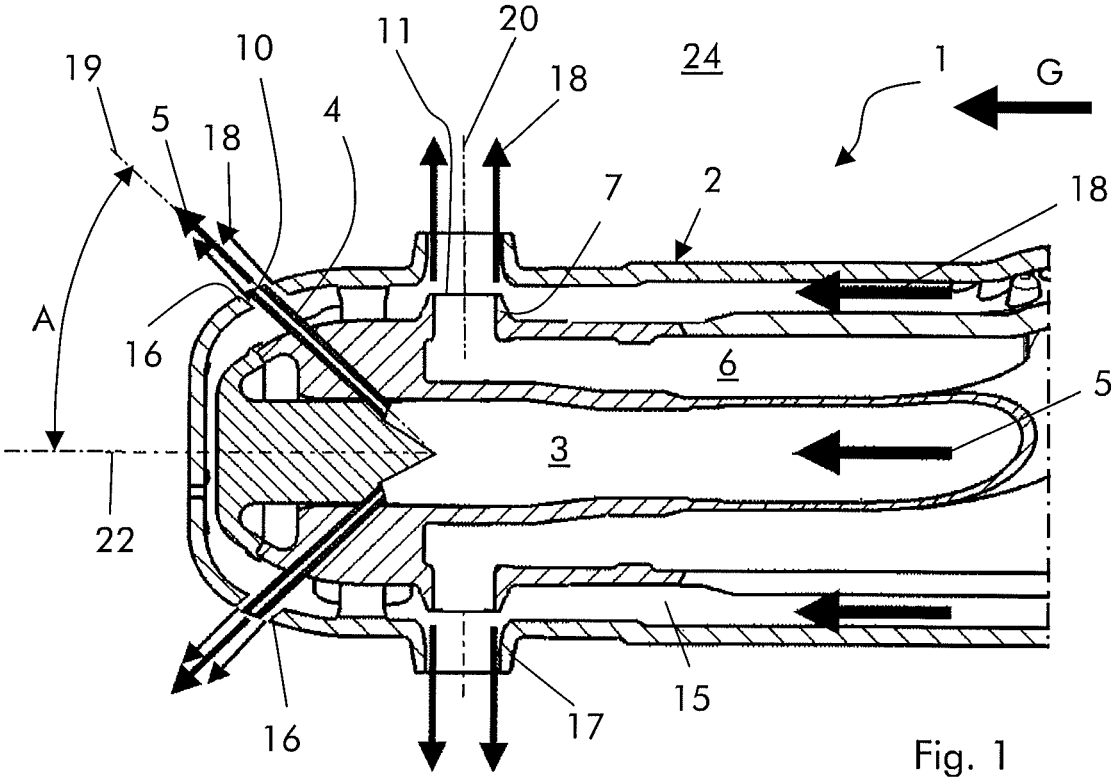
FIG. 1 is a schematic longitudinal cross section of a lance in an exemplary embodiment of the disclosure, during liquid fuel operation.

The disclosure relates to a lance that allows a cheap operation of the gas turbine, because it can permit the reduction in an amount of water to be injected together with the liquid fuel, when compared to gas turbines having known lances.

The disclosure relates to a lance in which the dimensions and proportions of the same lance and/or of the nozzles may be optimized, without the need for the nozzles of the gaseous fuel to suffer the constraints of the nozzles of the liquid fuel and vice versa.

With reference to the figures, these show a lance 1 of a burner, for example, a reheat burner.

The lance 1 includes a body 2 defining a first duct 3 with first nozzles 4 for injecting a liquid fuel 5, and a second duct 6 with second nozzles 7 for injecting a gaseous fuel 8.

As shown in the figures, the outlets 10 of the first nozzles 4 can be apart from the outlets 11 of the second nozzles 7.

For example, the outlets 10 of the first nozzles 4 can be axially shifted with respect to the outlets 11 of the second nozzles 7. Desirably, the outlets 10 can be downstream of the outlets 11 of the second nozzles 7 in the direction of the liquid fuel 5.

In addition, the body 2 includes a third duct 15 with third 16 and fourth 17 nozzles for injecting air 18.

The third nozzles 16 surround an axis 19 of the first nozzles 4 and the fourth nozzles 17 surround an axis 20 of the second nozzles 7.

The third nozzles 16 are defined by holes in the wall of the third duct 15. In addition, each hole houses a first nozzle 4 with a gap in between.

The free borders of the first nozzles 4 are flush with the surrounding wall of the third duct 15. In other words, the first nozzles 4 have their terminal portion inserted into the corresponding third nozzles 16 and the outlets 10 of the nozzles 4 are aligned with the outer surface of the wall defining the duct 15.

In the figures, the first nozzles 4 are coaxial with the third nozzles 16. Thus, the reference 19 identifies both the axes of the first and third nozzles 4, 16. The nozzles 4, 16 can also be non-coaxial.

Correspondingly, in the enclosed figures, the second nozzles 7 are coaxial with the fourth nozzles 17. Thus, the reference 20 identifies both the axes of the second and fourth nozzles 7, 17. The nozzles 7, 17 can also be non-coaxial.

The axes 19 of the first nozzles 4 can be inclined to the axes 20 of the second nozzles 7.

In addition, the axes 19 of the first nozzles 4 can be inclined to an axis 22 of a terminal portion of the lance 1 parallel to a reheat combustion burner longitudinal axis (typically, the axis 22 can overlap the reheat combustion burner longitudinal axis) by an angle A.

This can allow the liquid fuel to be injected into the mixing zone 24 outside of the lance 1 with a component of its velocity parallel to the hot gas G, reducing the time required for the fuel to pass through the mixing zone 24 (i.e., reducing the residence time of the liquid fuel within the burner mixing zone 24). Reduction of the residence time of the liquid fuel within the burner mixing zone 24 can allow reduction of the water to be mixed to the liquid fuel before injection.

In an exemplary embodiment, for operation without shielding air, no third and fourth nozzles 16, 17 are provided.

This lance can be mounted in a reheat burner.

The operation of the lance of the disclosure is apparent from that described and illustrated and is substantially the following.

Gaseous Fuel Operation

Figure 2:
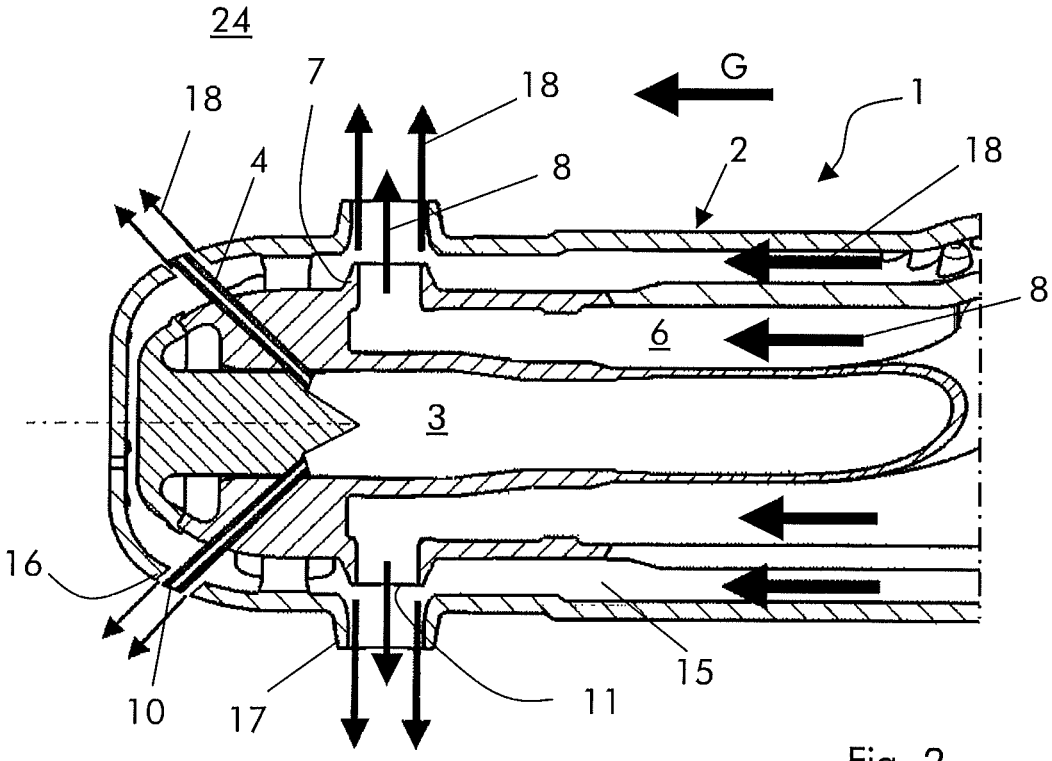
FIG. 2 is a schematic longitudinal cross section of the lance in the exemplary embodiment of FIG. 1, during gaseous fuel operation.

During gaseous fuel operation (FIG. 2), gaseous fuel 8 passes through the second duct 6, reaching the second nozzles 7 to be injected. As shown in the figures, gaseous fuel 8 can be injected perpendicularly to the hot gases G circulating within the burner mixing zone 24.

At the same time, air (shielding air) passes through the third duct 15, reaching the fourth nozzles 17, from which it is injected, generating a shielding that encircles the gaseous fuel 8 injected from the second nozzles 7.

In addition, the air 18 also reaches the third nozzles 16, from which it is injected. In this case no liquid fuel is injected through the first nozzles 4.

Liquid Fuel Operation

During liquid fuel operation (FIG. 1), liquid fuel 5 passes through the first duct 3, reaching the first nozzles 4 from which it is injected into the mixing zone 24 of the burner. As shown in the figures, liquid fuel 5 can be injected with a velocity component parallel and a velocity component perpendicular to the hot gases G circulating within the mixing zone 24.

In addition, air 18 passes through the third duct 15, reaching the fourth nozzles 17, from which it is injected into the mixing zone 24 (no gaseous fuel is injected) and the third nozzles 16, from which it is injected, generating a shielding that encircles the liquid fuel 5.

Alternatively, also operation without shielding air may be envisaged.

Because design of the first nozzles 4 (for the liquid fuel) does not have the constraints of the gaseous fuel, and correspondingly because the design of the second nozzles 7 (for the gaseous fuel) does not have the constraints of the liquid fuel, the position, number and features of the nozzles can be chosen to optimize the gas turbine operation.

The second nozzles 7 (for the gaseous fuel) can be shifted upwards when compared to traditional lances, because flashback constraints mainly due to the liquid fuel can be avoided.

Correspondingly, the first nozzles 4 can be shifted downwards or can be inclined to the axes 20 or axis 22 according to the needs to reduce liquid fuel residence time, without the constraints of the gaseous fuel that requires long residence times. Thus gas turbine operation can be optimized, to reduce flashback risks and achieve low emissions (for example NOx, CO, unburned hydrocarbons).

For example, residence time of the liquid fuel in the burner can be reduced by shifting the first nozzles 4 downwards and/or reducing the angles A between the axis 22 and the first nozzles axes 19. Because the flashback risk of liquid fuel can be reduced, the amount of water to be mixed to the same liquid fuel can in turn be reduced.

Naturally the features described may be independently provided from one another.

In practice, the materials used and the dimensions can be chosen at will according to requirements and to the state of the art.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE NUMBERS

1 lance
2 body of 1
3 first duct
4 first nozzles
5 liquid fuel
6 second duct
7 second nozzles
8 gaseous fuel
10 outlet of 4
11 outlet of 7
15 third duct
16 third nozzles of 15
17 fourth nozzles of 15
18 air
19 axis of 4
20 axis of 7
22 axis of the terminal portion of the lance
24 mixing zone
A angle between 19 and 22
G hot gases

What is claimed is:

1. A lance for a burner comprising:
a lance body including:
a first duct with first nozzles for injecting a liquid fuel;
a second duct with second nozzles for injecting a gaseous fuel, wherein outlets of the first nozzles are spaced apart from outlets of the second nozzles; and
a third duct with third and fourth nozzles for injecting air, wherein the third nozzles surround an axis of the first nozzles and the fourth nozzles surround an axis of the second nozzles, wherein the outlets of the first nozzles are downstream of the outlets of the second nozzles, axes of the first nozzles are inclined relative to axes of the second nozzles, and axes of the first nozzles are inclined relative to an axis of a terminal portion of the lance.

2. The lance as claimed in claim 1, wherein the third nozzles are defined by holes in a wall of the third duct.

3. The lance as claimed in claim 2, wherein each hole defining a third nozzle houses a first nozzle.

4. The lance as claimed in claim 3, wherein free borders of the first nozzles are flush with a surrounding wall of the third duct.

5. A reheat burner, comprising a lance, including:
a first duct with first nozzles for injecting a liquid fuel;

a second duct with second nozzles for injecting a gaseous fuel, wherein outlets of the first nozzles are spaced apart from outlets of the second nozzles; and a third duct with third and fourth nozzles for injecting air, wherein the third nozzles surround an axis of the first nozzles and the fourth nozzles surround an axis of the second nozzles, wherein the outlets of the first nozzles are downstream of the outlets of the second nozzles, axes of the first nozzles are inclined relative to axes of the second nozzles, and axes of the first nozzles are inclined relative to an axis of a terminal portion of the lance.

6. The reheat burner as claimed in claim 5, wherein the third nozzles are defined by holes in a wall of the third duct.

7. The reheat burner as claimed in claim 6, wherein each hole defining a third nozzle houses a first nozzle.

8. The reheat burner as claimed in claim 7, wherein free borders of the first nozzles are flush with a surrounding wall of the third duct.

* * * * *